US005524995A

United States Patent [19]

Brookner et al.

[11] Patent Number: 5,524,995

[45] Date of Patent: Jun. 11, 1996

[54] APPARATUS AND METHOD FOR DETECTING THE POSITION OF ENVELOPES IN A MAILING MACHINE

[75] Inventors: George M. Brookner, Norwalk; Kevin D. Hunter, Stratford; Walter J. Kulpa, Trumbull; Edward Mailhot, Stamford, all of Conn.

[73] Assignee: Pitney Bowes, Inc., Stamford, Conn.

[21] Appl. No.: 338,293

[22] Filed: Nov. 14, 1994

[51] Int. Cl.[6] ..... B41J 13/26

[52] U.S. Cl. ..... 400/596; 400/708; 400/709; 400/279

[58] Field of Search ..... 400/708, 709, 400/596, 233, 235, 596, 279; 355/311; 395/111; 364/464.02, 464.03

[56] References Cited

U.S. PATENT DOCUMENTS

| | | | |
|---|---|---|---|
| 4,638,732 | 1/1987 | Salazar et al. | 101/91 |
| 4,643,089 | 2/1987 | Salazar et al. | 101/91 |
| 4,665,353 | 5/1987 | Salazar et al. | 318/599 |
| 4,767,228 | 8/1988 | Harry | 400/234 |
| 4,867,058 | 9/1989 | Luckhurst | 101/93.05 |
| 4,960,336 | 10/1990 | Brooks et al. | 400/61 |
| 5,212,531 | 5/1993 | Monma et al. | 355/316 |
| 5,260,716 | 11/1993 | Maslanka | 346/76 PH |
| 5,325,114 | 6/1994 | Fogle et al. | 346/76 PH |
| 5,331,576 | 7/1994 | Eckert, Jr. et al. | 364/589 |
| 5,350,245 | 9/1994 | Gallagher | 400/582 |

FOREIGN PATENT DOCUMENTS

0573701A1 12/1993 European Pat. Off. .

*Primary Examiner*—John S. Hilten
*Attorney, Agent, or Firm*—Angelo N. Chaclas; Charles G. Parks, Jr.; Melvin J. Scolnick

[57] ABSTRACT

An apparatus and method is disclosed for controlling the operation of a mailing machine having a postage meter which includes a thermal printer which transfers wax ink from an ink ribbon to an envelope being fed through the mailing machine, in such a way that the printer cannot operate if the envelope is not is a proper position in the mailing machine to completely cover a feed roller which controls movement of the envelope and the ink ribbon. The mailing machine includes a microprocessor that responds to sensors positioned along the feed path of the envelope to prevent initiation of a printing operation if an envelope is not properly positioned in the mailing machine, and which terminates an ongoing printing operation in the event, either that the envelope becomes skewed with respect to the normal direction of feed such that it will expose a portion of the feed roller, or that the envelope is too short to receive the entire image which is intended to be printed thereon before the trailing edge of the envelope would uncover the feed roller.

12 Claims, 10 Drawing Sheets

APPARATUS AND METHOD FOR DETECTING THE POSITION OF ENVELOPES IN A MAILING MACHINE

BACKGROUND OF THE INVENTION

The present invention relates generally to the field of mailing machines for printing a postage indicia on an envelope to evidence the payment of postage, and more particularly to a mailing machine having a thermal printer in which the postage indicia is generated on the envelope by the process known as thermal transfer printing.

Mailing machines have long been well known, and are found both in the art and in commercial use in a wide variety of configurations and incorporating several forms of printing devices. At the present time, the great majority of mailing machines in use include printing devices which utilize the well known ink offset printing technology, in which ink is applied to a suitable printing die which has been engraved with the text and associated graphic material constituting the postage indicia, and from which the ink is transferred from the die to the surface of an envelope that is pressed against the die. This technique involves several disadvantages, one being that it requires the rather laborious and expensive procedure of engraving various forms of dies with intricate graphic and text material by well known engraving processes. In the majority of configurations of postage meters, the printing die is mounted on a rotary drum which forms part of the feeding mechanism for the envelopes. The dies, therefore, must conform to the curvature of the drum, which renders the engraving process all the more difficult and expensive.

Another disadvantage of this offset printing technique is that it requires a rather complicated inking apparatus to apply an even coating of ink to the printing die after each printing operation, which further adds to the complexity and cost of the mailing machine, and also involves constant maintenance. Thus, this printing technique is most suitable for installations such as large mailers in which the mailing machine will be used for consistently lengthy periods of time to make perhaps thousands, if not tens of thousands, of imprints. The difficulty and cost of making printing dies for use in the ink offset printing technique renders this technique unsuitable and impractical for postage meters intended for use over a limited period of time by relatively small users.

A further disadvantage of the offset printing technique arises in connection with the use of advertising slogans, which are printed adjacent to the postage indicia by another printing die mounted on the rotary drum. These dies tend to be costly since they are made up in small quantities, and may even be made as a single die on custom order for particular customers who may wish to change their advertising slogan more frequently than is economically possible with engraved dies.

It is thus apparent that there is a need for a relatively simple and inexpensive mailing machine having a postage meter printing device which is based on a printing technology that is readily available, and which can be incorporated in a postage meter printing device that is relatively simple in construction, inexpensive to manufacture, reliable in operation easy to operate and maintain, and which prints a sufficiently high quality postage indicia that will meet the stringent standards for postage indicia set by the United States Postal Service.

To meet this need, a well known printing technique has been modified for use in mailing machines which entirely eliminates the need for relatively expensive engraved printing dies and the complex and expensive inking apparatus that is required for use with such dies. This technique is thermal printing, which has been utilized for some time in various forms of printing applications, such as calculators, cash registers, facsimile machines, etc., in which a specially designed thermally responsive paper is selectively heated in a particular configuration to produce the desired image. In a mailing machine, however, where it is desired to print the postage indicia on plain paper, the image must still be deposited in the form of ink which is impregnated into the paper.

In order to get an ink image onto plain paper using a thermal process, it is necessary to supply the ink, which is a dye in a wax, polymer or wax and polymer base, in the form of a ribbon consisting of a very thin plastic film, similar to that used for wrapping food, on which is deposited a layer of wax which contains a suitable dye to impart a desired color to the wax. The ribbon is passed over a printing surface which contains an array of extremely small high temperature resistor type heaters, each individually actuated by a software-controlled microprocessor. As an envelope moves across the printing surface with the surface of the envelope in contact with the ink ribbon, individual heaters are actuated in a predetermined sequence under the control of the microprocessor to deposit small dots of ink on the surface of the envelope, thereby forming the desired image of the postage indicia.

A mailing machine having a thermal printing device as just briefly described has several distinct advantages over the more conventional die and ink printing devices described above. One major advantage is that the image printed by a thermal printer postage meter is determined by a software controlled microprocessor, which energizes the array of heaters in a sequence previously programmed into the software. The image to be printed can thus be changed at will merely by changing the software. This capability has the distinct advantage that the same postage meter can be used in any country in the world merely by providing software that has been programmed to print an image corresponding to the image of the standard postage indicia for a particular country. This is both far more convenient and economical to the manufacturer than having to provide differently engraved plates for each country in which the mailing machine might be marketed.

In like manner, mailing machine customers who wish to print a personalized slogan, such as advertising, commemorating a holiday, promoting a cause, or other personal message, together with the postage indicia, can do so with a thermal printer postage meter merely by obtaining software programmed for the particular slogan. Again, as with the postage indicia dies, it is more convenient and economical for customers, especially small volume users, to procure software when they desire to change their slogans than it is to procure different engraved dies.

Some other important advantages of the thermal printing device are that they are far less complex in structure, and hence much more economical to manufacture, easier to install and maintain, and require less service than a conventional postage meter. All of these factors contribute significantly to making a thermal printer postage meter more economically appealing to small and medium size mailers than the conventional postage meter.

A major problem, however, that occurs with this type of thermal printer is the possibility that wax ink will be transferred from the ink ribbon to a pressure roller that is mounted on the side of the envelope opposite the surface thereof on which the postage indicia is printed. The ink ribbon is normally packaged in a cartridge and is mounted on a supply spool, from which it is passed across the printing surface containing the heaters and is taken up on a driven take up spool. The take up spool is driven only for the purpose of maintaining the ribbon under tension between the spools, and not for the purpose of pulling the ribbon across the printing surface when it is in contact with an envelope during a printing operation. This would probably break the ribbon. Therefore, the ribbon is moved across the printing surface merely by the friction imposed between the envelope and the ribbon by a back up pressure roller which is maintained in contact with the opposite side of the envelope and engages it with sufficient friction to move the envelope and the ink ribbon across the printing surface.

In this arrangement, it should be apparent that if any wax based ink is deposited on the back up pressure roller, it will act like a lubricant on the surface of the roller to substantially reduce the coefficient of friction between the rubber surface of the roller and the surface of the envelope, thereby resulting in slippage of the envelope and the ribbon and consequently the printing of a postage indicia of illegible and unacceptable quality. This problem is exacerbated by the fact that it is virtually impossible to sufficiently clean wax from the porous surface of a rubber feed roller to restore the roller to its original coefficient of friction, with the result that if wax based ink is deposited on the roller from the ink ribbon, the roller must be replaced, which usually requires a service call and results in down time of the mailing machine to the customer. These problems do not exist in the conventional ink offset type printing devices because the rotary drum with the curved printing dies, acting in cooperation with a back up roller, contributes to the feeding of the envelope, with the result that the envelope is contacted on one side by the pressure roller and on the other side by the printing die, thereby assuring proper feeding of the envelope even if ink somehow is deposited on the back up pressure roller. The worst consequence of this is that the pressure roller will deposit a smudge of ink on the back of the envelope.

It is therefore apparent that there is a need for a thermal printer having certain features of control over the operation thereof that it becomes impossible for the printer to operate in the event that any part of the backup pressure roller is exposed to the ink ribbon, either during passage of an envelope through the printer, or before an envelope has entered into or exited from the printer. Thus, the present invention is directed to providing control components that will effectively control the operation of the printer to prevent operation thereof when certain circumstances exist under which it would be inappropriate for the printer to operate. The present invention also contemplates a method of detecting the precise location and orientation of an envelope within a printer as it moves through a succession of processing locations to enable the control components to effectively control the operation of the printer.

SUMMARY OF THE INVENTION

The present invention greatly obviates, if not entirely eliminates, the disadvantage and shortcomings of conventional postage meter printing devices, and does so in a way which provides advantageous features not heretofore available. In its broadest aspects, the present invention is in a mailing machine for printing an image on the upper surface of envelopes as they are fed seriatim along a feed path through the mailing machine, and comprises generally an elongate feed deck along which envelopes are adapted to be fed seriatim, and an upstanding wall extending along the feed deck which defines a registration guide along which the upper edge of the envelopes are normally registered as they move along the feed deck. The invention includes a thermal printing device disposed along the feed deck which has a printing face disposed in vertically spaced juxtaposition with the feed deck, an elongate array of heating elements disposed on the printing face, and an ink coated ribbon disposed in heat transfer contact with the array of heating elements on the printing face. A feeding means is disposed beneath the feed deck for simultaneously feeding envelopes along the feed deck and for maintaining the upper surface of the envelopes in contact with the lower surface of the ink ribbon with sufficient pressure that the movement of the envelopes moves the ink ribbon in synchronism with the envelopes, and to effect proper thermal contact between the envelope, the ribbon and the heating elements, the feeding means including a feed roller mounted for vertical movement between a first position in which the roller is disposed out of contact with the under surface of the envelope and a second position in which the roller is in contact with the under surface of the envelope and is then effective to press the envelope and the ink ribbon against the printing face and to feed the envelope and the ink ribbon, and means for moving the roller between the first and second positions. Finally, there is a control means that is .operable to initiate a printing operation of the printer when an envelope is properly positioned on the feed deck to fully cover the feed roller, and to prevent initiation of a printing operation when an envelope is not properly positioned on the feed deck to fully cover the feed roller, or to terminate an active printing operation at any time that an envelope will not be properly positioned to cover the feed roller before the active printing operation would otherwise be completed. With this control arrangement, the printing device is prevented from printing on any portion of the feed roller under either of the foregoing conditions.

In some of its more limited aspects, the control means includes a sensing means disposed along the feed deck adjacent the registration guide, the sensing means being effective to detect when an envelope is properly positioned on the feed deck to cover the feed roller before initiation of a printing operation and to detect when an envelope is not properly position on the feed deck to cover the feed roller after initiation of a printing operation. The sensing means includes a first and second sensing elements disposed along the feed deck, the first sensing element being disposed at a first location which is a predetermined distance downstream from the feed roller, the second sensing element being disposed at a second location which is a predetermined distance upstream from the feed roller, the first sensing means being normally operative to actuate the means for moving the feed roller to move the feed roller from the first position to the second position to commence operation of the printing device to initiate a printing operation when the leading edge of an envelope reaches the first location and said second sensing means also detects the presence of an envelope at the second location.

Also, the second sensing element is mounted in close proximity to the registration guide to detect the presence of the upper edge of an envelope in registration with the guide, and which either prevents the first sensing element from initiating operation of the printing device, or terminates an ongoing operation of the printing device, if the second sensing element detects the absence of the upper edge of the envelope along the registration guide. The aforementioned functions of initiating a printing operation when an envelope is properly position to cover the feed roller, and to initially prevent or terminate a printing operation if an envelope is or becomes improperly positioned to cover the feed roller are directed by a microprocessor which is under the control of the sensing elements and which has both memory capability for storing information pertinent to the length of image to be printed and suitable electronic capability for comparing the location and distance of travel of an envelope as determined by the sensing elements with the image length information stored in the memory so as to terminate a printing operation if there is insufficient envelope to receive the full extent of the image to be printed.

With regard to the method invention, in its broadest aspects the invention is a method of detecting the location and orientation of an envelope moving along a designated feed path through a mailing machine having a thermal printer which includes a print head for printing a postage information image on the envelope, and of controlling the operation of a microprocessor in the printer to prevent it from operating when any portion of a feed roller for moving the envelope along the feed path is not fully covered by the envelope. In this environment, the method comprises the steps of storing in memory first data indicative of the number of print columns in the length of the postage information image to be printed; storing in memory second data indicative of a number of print columns which is in excess of the number of print columns indicated by the first data; detecting when an envelope inserted into the mailing machine is properly position along the feed path so that it completely covers the feed roller; providing the microprocessor with a signal that the envelope is properly positioned as aforesaid to cause the microprocessor to activate the feed roller and the printer to initiate a printing operation; detecting when the trailing edge of the envelope reaches a predetermined position along the feed path to generate third data indicative of the number of print columns in the length of the envelope remaining between the trailing edge thereof and the print head, and transmitting the third data to the microprocessor; comparing the third data with the first and second data to determine whether there is sufficient envelope remaining between the trailing edge thereof and the print head to accept the full postage information image to be printed; and terminating the printing operation at an appropriate time depending on whether the third data is more or less than the first and second data, so that the printing operation is terminated while the envelope still covers the feed roller to prevent any ink from the ribbon from being transferred to the feed roller.

In some of its more limited aspects, the method invention includes the steps of reducing the first and second data by a factor of one each time a print column is printed until the first data reaches zero but before the second data reaches zero if the trailing edge of an envelope is not detected at the predetermined position prior to the first data reaching zero, and terminating the printing operation at that time since the entire postal information image intended to be printed will have been printed. Correspondingly, the invention includes the steps of reducing the first and second data by a factor of one each time a print column is printed until the second data reaches zero but before the first data reaches zero if the trailing edge of an envelope is detected at the predetermined position prior to the first data reaching zero, and terminating the printing operation at that time, or at some predetermined time after that, since there is insufficient envelope remaining on which to print the entire postage information imaged intended to be printed.

Having briefly described the general nature of the present invention, it is a principal object thereof to provide a mailing machine having a postage meter for printing an image on the upper surface of envelopes moving through the mailing machine in which the postage meter includes a thermal printing device.

It is another object of the present invention to provide a mailing machine of the type just described in which the thermal printing device includes control features which Will prevent operation of the printing device at any time that an envelope is not properly positioned to receive ink from an ink ribbon contacted by the envelope during a normal printing operation.

It is still another object of the present invention to provide a mailing machine of the type described in which the control features which prevent operation of the printing device are effective both to prevent operation of the printing device in the event that an improperly fed envelope exposes a portion of a feed roller, and to terminate an active operation of the printing device in the event that the envelope is too short to accept the full extent of the image normally being printed by the printing device.

It is yet another object of the present invention to provide a method of controlling the operation of a printing device in a mailing machine such that operation of the printing device is either initially prevented in the event that an envelope is not properly positioned in the mailing machine to receive an image from the printing device, or is terminated after initiation if the envelope is either improperly fed into the mailing machine or is too short to receive the full extent of an image intended to be printed.

These and other objects and advantages of the present invention will become more apparent from an understanding of the following detailed description of a presently preferred embodiment of the invention, when considered in conjunction with the accompanying drawings.

DETAILED DESCRIPTION OF THE PREFERRED EMBODIMENT

Figure 1:
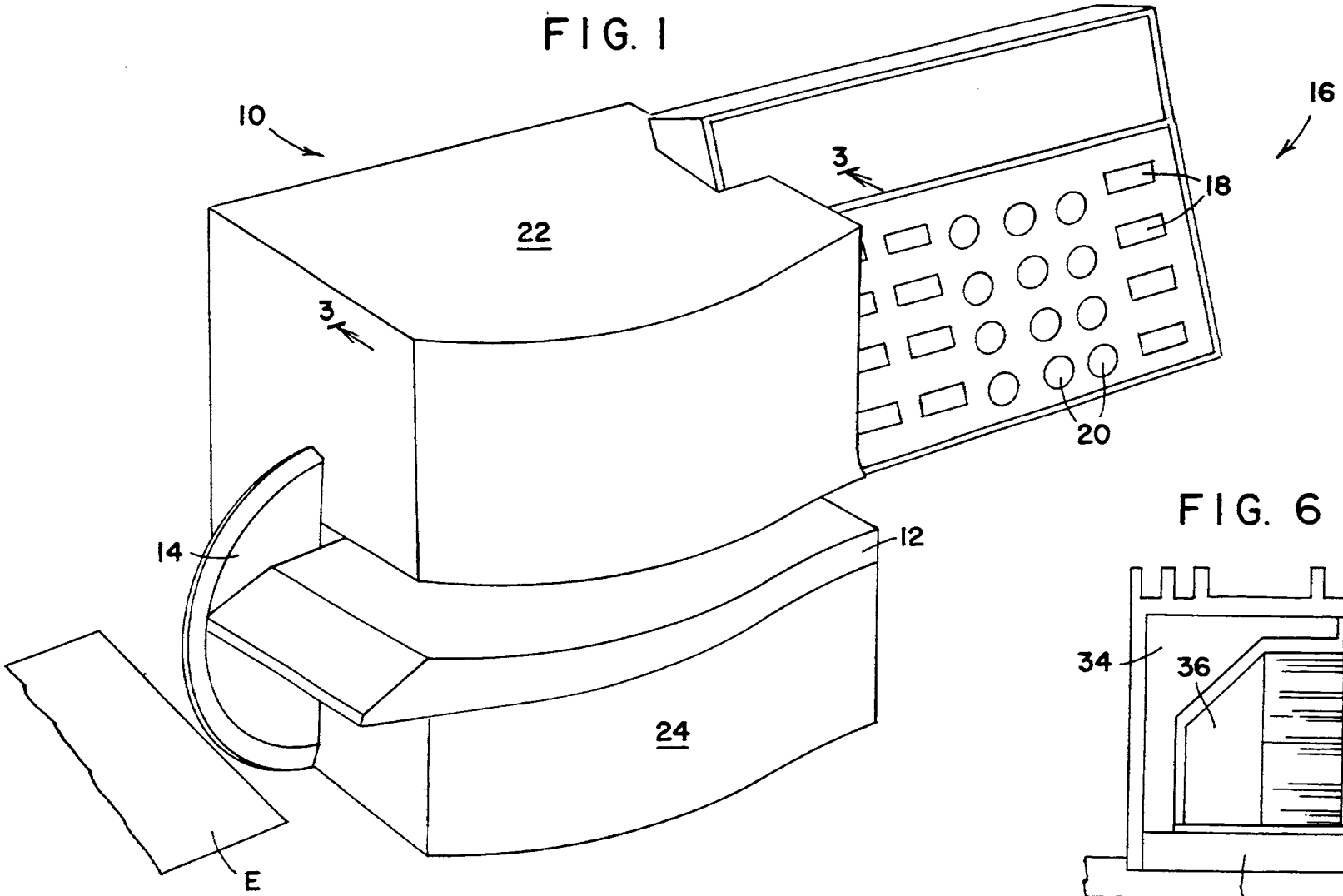
FIG. 1 is a general perspective view of a mailing machine incorporating the principles of the present invention.

Referring now to the drawings, and particular to FIG. 1 thereof, the principles of the present invention are embodied in a mailing machine, indicated generally by the reference numeral 10. The mailing machine 10 includes an elongate, horizontally disposed feed deck 12 along which envelopes E are adapted to be manually fed as hereinafter more fully described. An upstanding guide 14 provides a registration wall against which the envelopes E are pushed to establish a proper direction of feed of the envelopes E through the mailing machine, and suitable guide surfaces 15 are provided along the length of the feed deck 12 to guide the envelopes pass through the mailing machine 10 along the prescribed feed path. The mailing machine 10 also includes a control panel, indicated generally by the reference numeral 16, which has suitable control buttons 18 for setting various control parameters of the mailing machine, and a standard keypad having buttons 20 for setting the digital amount of postage which will be printed as part of the postage indicia. Suitable upper and lower housings 22 and 24 enclose the working components of the thermal printer of the mailing machine as further described below. It should be understood at this point that various types of mailing machines in general are very well known in the art, and accordingly only so much of mailing machine technology as is necessary to an understanding of the present invention is specifically disclosed herein.

Figure 6:
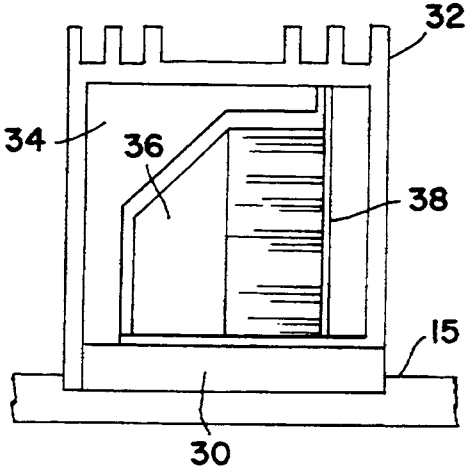
FIG. 6 is a view of the underside of the printing surface of the print head, showing the location of the array of heating elements that are part of the thermal printer.
Figure 2:
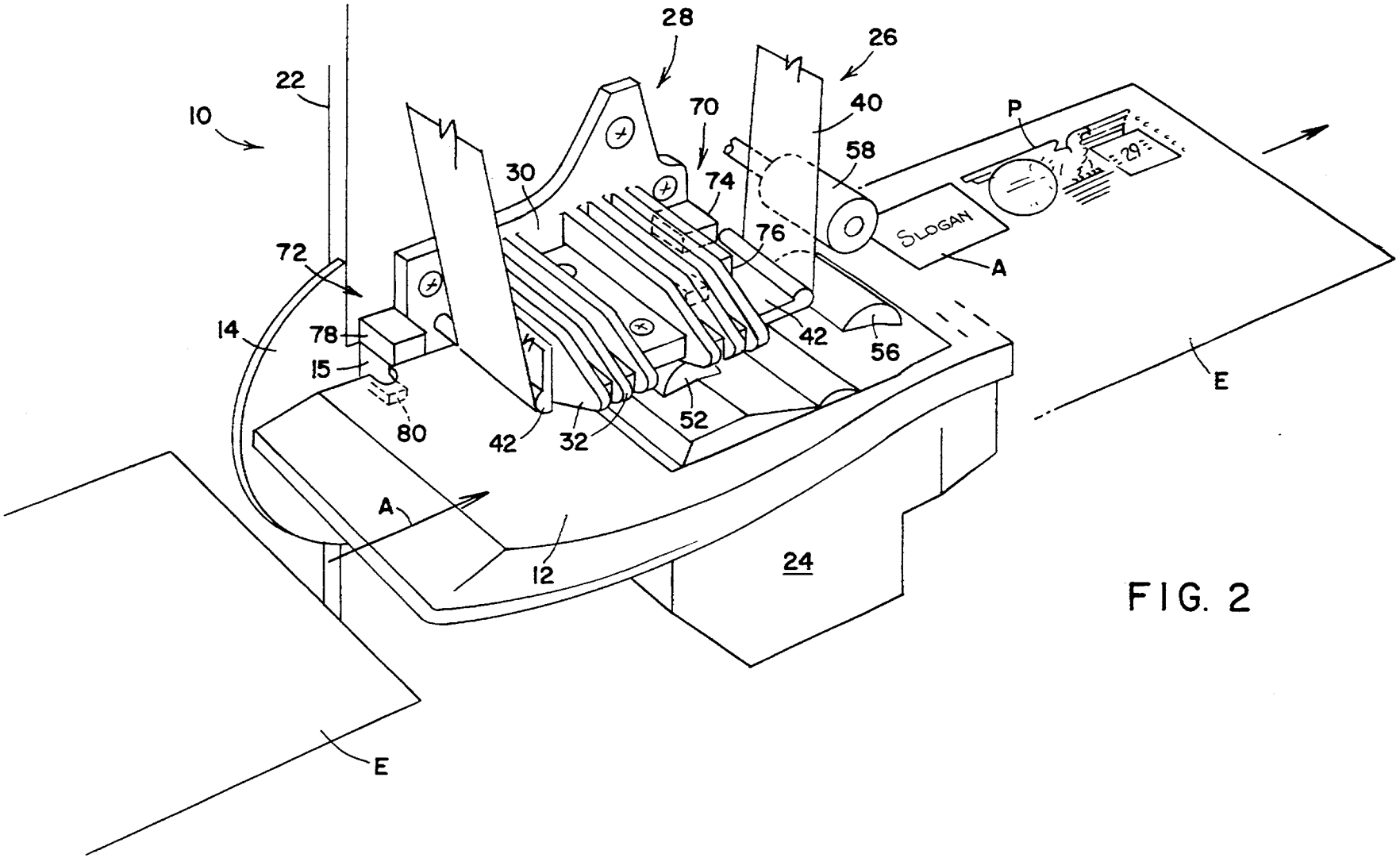
FIG. 2 is a perspective view of the feed deck and thermal print head of the mailing machine shown in FIG. 1.
Figure 3:
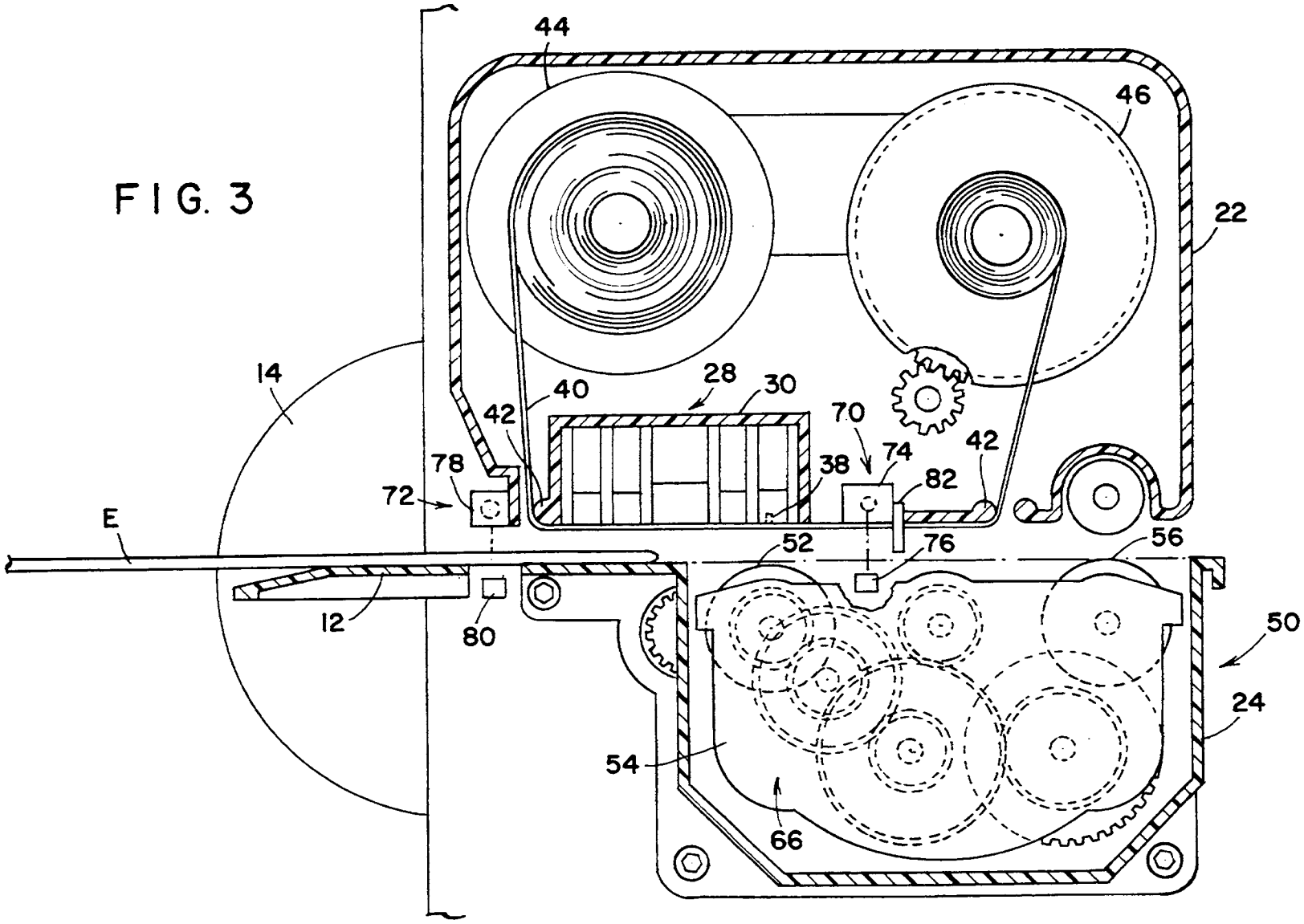
FIG. 3 is a sectional view taken on the line 3—3 of FIG. 1, but without the control panel shown in FIG. 1, showing the printing and ejecting roller assembly in a neutral position.

Referring now to FIG. 2, a portion of the thermal printing device for the mailing machine 10 is shown, as indicated generally by the reference numeral 26, and includes a print head indicated generally by the reference numeral 28 which includes a body member 30 having a plurality of cooling fins 32. As best seen in FIG. 6, the underside of the body member 30 includes a printing surface 34 which includes an area 36 on which a suitable printed circuit is adhered to provide connections for an elongate array of heating elements, represented by the line 38. The printing device 26 also includes a ribbon 40 which typically comprises a very thin plastic film, similar to that used for wrapping food, on which is disposed a layer of meltable carrier containing a dye to impart color to the ink. As best seen in FIG. 3, the body member 22 includes suitable guide portions 42 for guiding the ribbon 40 from a supply spool 44, underneath the body member 30 and then to a take up spool 46.

Figure 4:
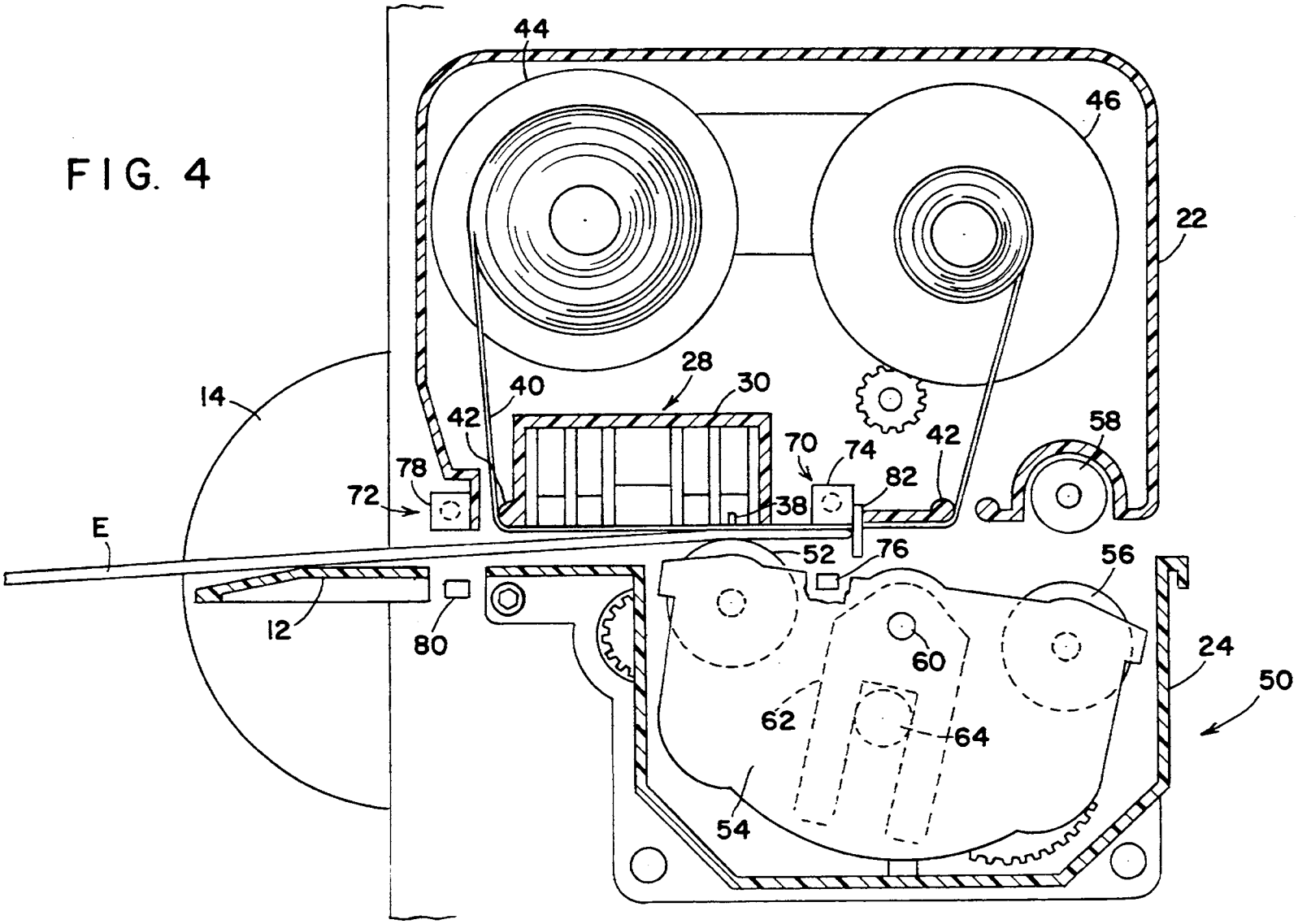
FIG. 4 is a view similar to FIG. 3 showing the printing and ejecting roller assembly in a printing position.
Figure 5:
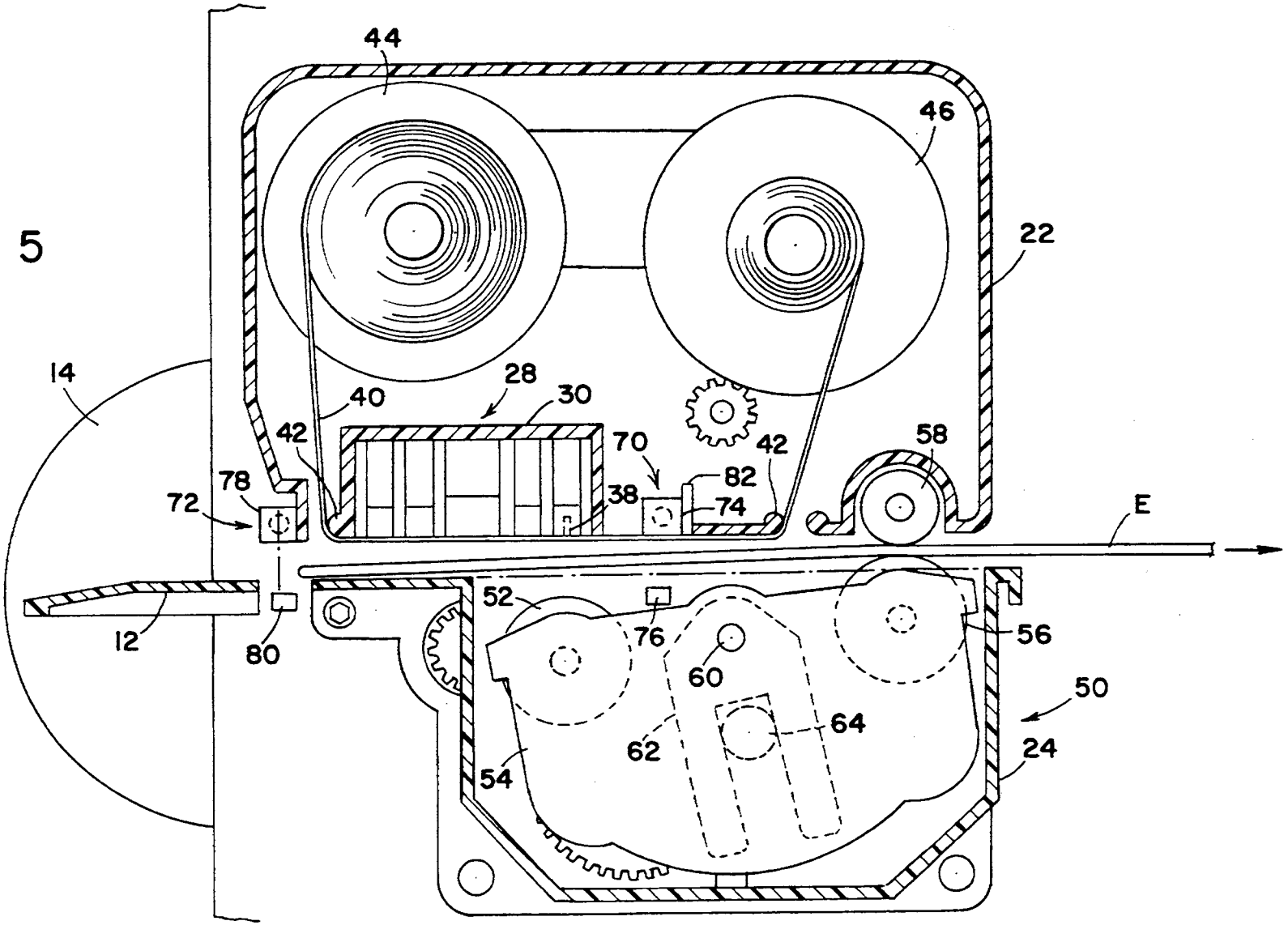
FIG. 5 is a view similar to FIG. 3 showing the printing and ejecting roller assembly in the ejecting position.

With reference now to FIGS. 3, 4 and 5, the printing device 26 further includes a feeding and eject assembly, indicated generally by the reference numeral 50, the principal functions of which are to feed an envelope E and the ribbon 40 simultaneously to enable the print head 28 to print a desired image on the envelope, and to eject the envelope from the printing device 26 when the printing operation is complete without further loss of ribbon 40. Thus, the feeding and eject assembly 50 includes a feeding roller 52 rotatably mounted on an oscillating frame 54, the horizontal axis of the feed roller 52 being located vertically beneath the line 38 representing the array of heating elements. The feeding and eject assembly 50 also includes an eject roller 56 which is also rotatably mounted on the oscillating frame 54, but spaced downstream a predetermined distance from the feed roller 52. A back up idler roller 58 is suitably mounted in the mailing machine 10 in vertically spaced orientation to the eject roller 56. As best seen in FIGS. 4 and 5, the frame 54 is mounted on a suitable shaft 60 and includes a yoke assembly 62 and a roller 64 mounted on the end of a lever (not shown) which is oscillated by a suitable gear (not shown) driven by a reversible motor (see 92 in FIG. 11). As indicated in outline form in FIG. 3, the feed roller 52 and the eject roller 56 are driven through a suitable gear train, indicated generally by the reference numeral 66, also driven by a suitable motor (see 90 in FIG. 11). For a further description of the details of construction and operation of the feeding and eject assembly 50, reference is made to copending U.S. patent application Ser. No. 08/331,304, filed On Oct. 218, 1994 entitled "THERMAL PRINTER" and assigned to the assignee of this application.

As seen in FIGS. 2, 3, 4 and 5, a pair of sensors, indicated generally by the reference numerals 70 and 72, are disposed on opposite sides of the print head 28 at predetermined distances therefrom. The sensor 70 being on the downstream side of the print head 28 by a distance approximately equal to the desired length of a lead edge margin on the envelope prior to the lead edge of the postage information image to be printed on the envelope. The sensor 72 is located on the upstream side of the print head 28 by a distance arbitrarily selected to provide sufficient envelope length for printing after the sensor 72 detects the trailing edge of the envelope to accept the full length of a typical postage information image including the indicia, an inscription and an advertising slogan, all of which will normally fit without difficulty on a standard #10 envelope. The sensors 70 and 72 may be of any desired configuration and mode of operation so long as they perform the invented function of detecting the leading and trailing edges of an envelope at the predetermined locations of the sensors; however, for the purpose of illustration, the sensors 70 and 72 are photo responsive and comprise a pair of light emitting components 74 and 76 respectively, and a pair of photo receptors 78 and 80 respectively which are capable of distinguishing between the presence of light when the photo receptors 78 and 80 are exposed to the light emitters 74 and 76 and the absence of light when an envelope E is disposed between the light emitters 74 and 76 and the photo receptors 78 and 80. It will be seen that suitable openings are provided in the feed deck 12 to provide a direct path between each of the light emitters 72 and 74 and the associated photo receptors 78 and 80.

As seen in FIGS. 3, 4 and 5, a vertically movable lead edge stop element 82 is suitably mounted over the feed deck 12 immediately adjacent to the downstream sensor 70 in a position to block the movement of an envelope E along the feed deck 12 when the stop element is in the position shown in FIGS. 3 and 4. However, suitable means are provided, such as a solenoid (not shown) for raising the stop element 82 to the position shown in FIG. 5 upon receipt of a signal from a microprocessor (more fully described below) to allow the envelope E to move forwardly along the feed deck 12.

Figure 11:
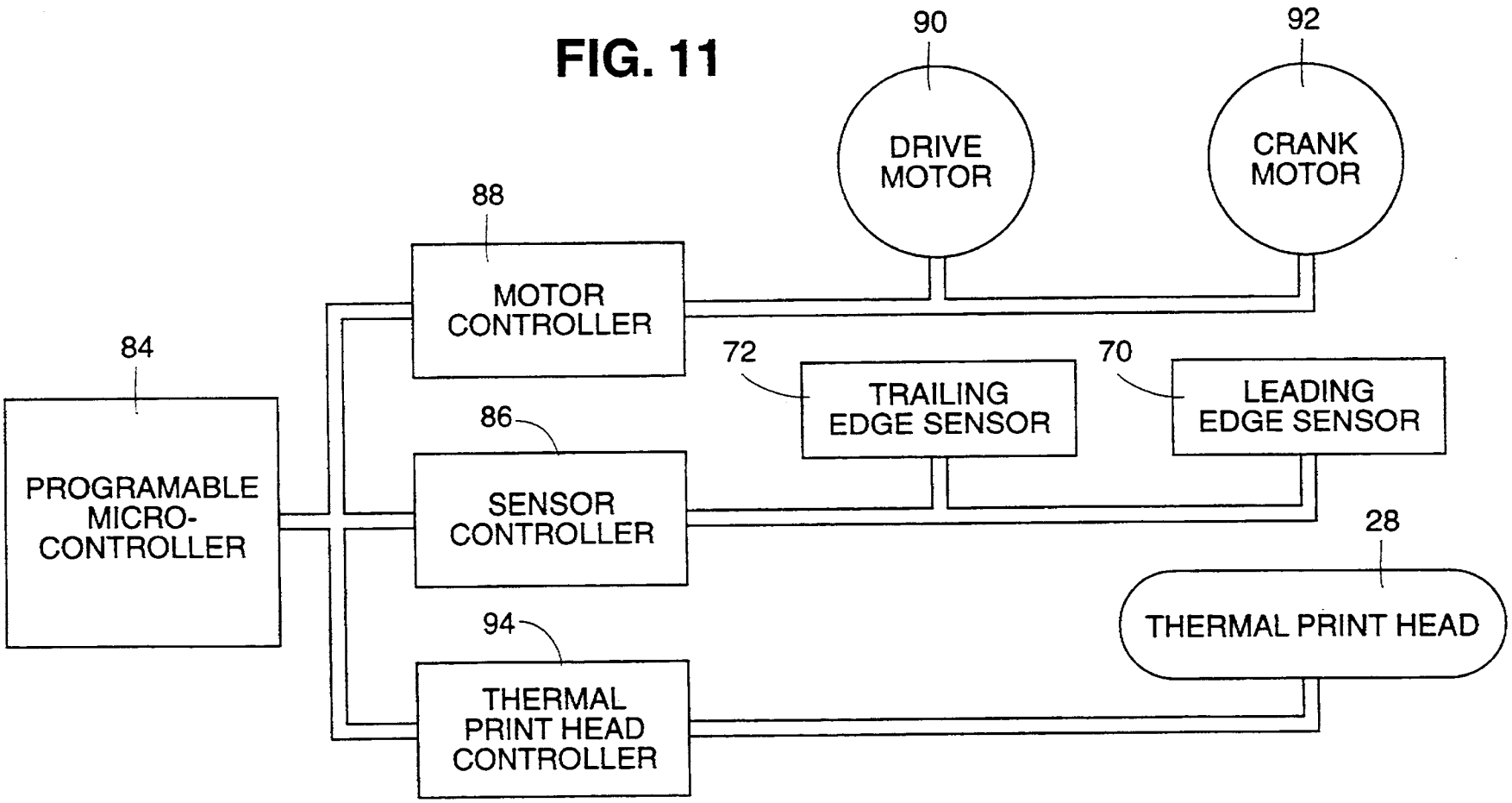
FIG. 11 is a block diagram showing the electrical communication between the major components of the apparatus of the present invention.

With reference now to FIG. 11, it will be seen that the mailing machine 10 includes a control means which is operable to initiate a printing operation only when an envelope is properly positioned on the feed deck 12 to fully cover the feed roller 52, and is operable to terminate a printing operation in the event that the envelope exposes all or a portion of the feed roller 52, either in the event that a short envelope is fed into the mailing machine 10 on which there is insufficient space to accept the full length of the postage information image which it is desired to print, or the envelope moves along the feed deck with a slight degree of skew with respect to a proper direction of feed along the registration wall 14, but which is sufficient to expose a portion of the feed roller 52 above the upper edge of the envelope E. In either situation, it is the function of the control means to terminate the printing operation before the print head 28 has an opportunity to deposit ink from the ribbon 40 on any portion of the feed roller 52.

Thus, as seen in FIG. 11, the aforementioned control means includes a microprocessor 84 for controlling all of the functions required for operation of the mailing machine 10, the details of which will be further described hereinbelow with reference to FIG. 12. A sensor controller 86 is connected to the microprocessor 84 and to the leading and trailing edge sensors 70 and 72, and a motor controller 88 is connected to the microprocessor 84 and to a drive motor 90 for driving the feed roller 52 and a crank motor 92 for oscillating the frame 54. A thermal print head controller 94 is connected to the microprocessor 84 and to the print head 28 to cause it to initiate a printing operation.

Figure 12:
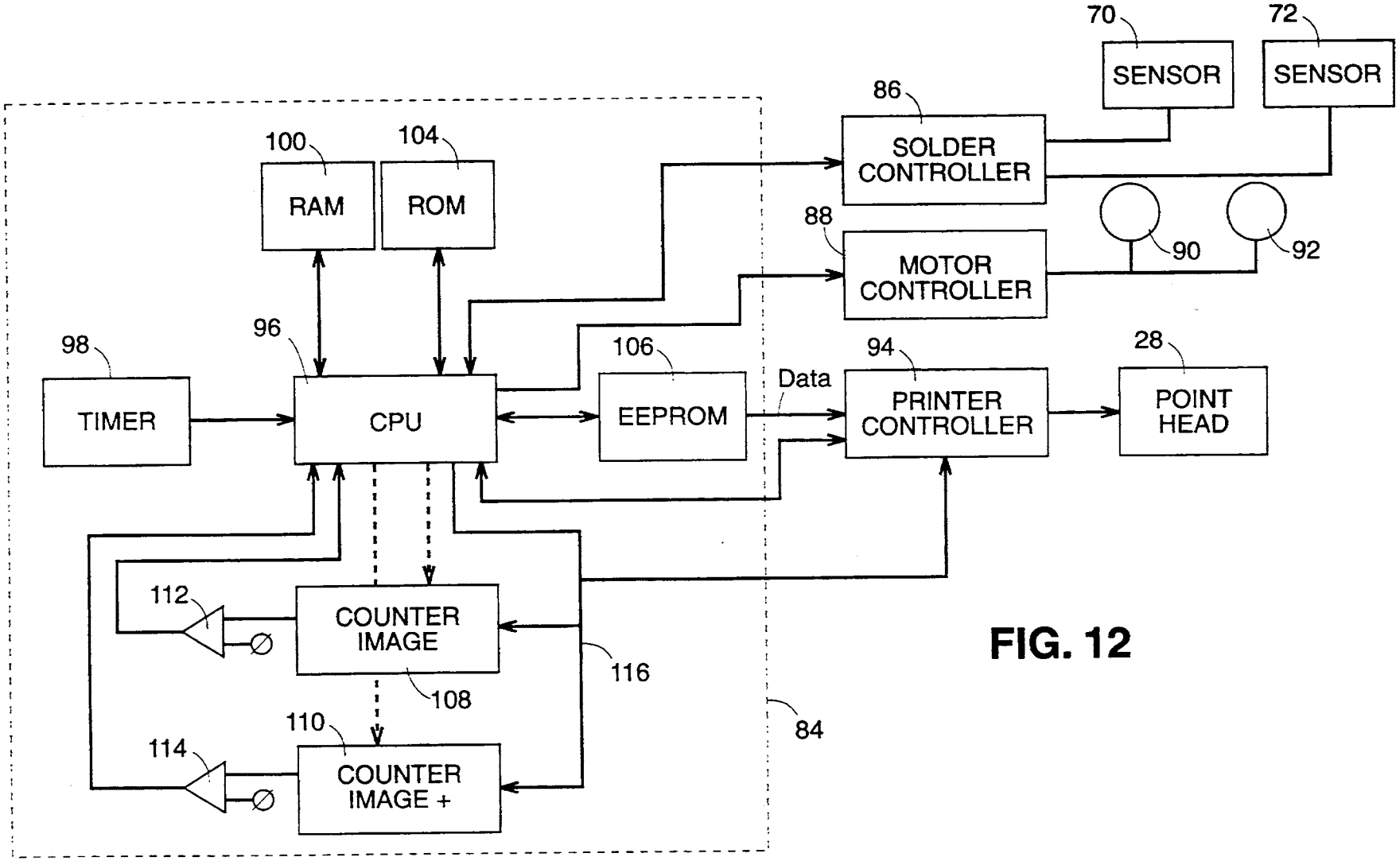
FIG. 12 is a block diagram of the principal components of the microprocessor shown in FIG. 11.

Referring now to FIG. 12, the essential components of the microprocessor 84 are shown, which include a central processing unit (CPU) 96 which controls all of the functions performed by the major components of the mailing machine 10 described above. The microprocessor 84 includes a timer 98 to generate a signal to the CPU 96 that it is time to step the motor 90 to rotate the feed roller 52 to move the envelope, and also the activate the print head 28. The period of the timer 98 is adjusted to control the speed of the envelope E at any point in time, by controlling the interval between motor steps. During the actual printing process, the timer 98 operates at a constant rate, and thus the envelope is transported at a constant rate. The timer 98 also causes the CPU 96 to sample the two sensors 70 and 72 several hundred time per second to ascertain whether there has been a change in the status of either of the sensors 70 and 72 so that the CPU 96 knows the precise instant at which the envelope blocks or unblocks either of the sensors. The sensors 70 and 72 are sampled in synchronization with the printing process, which greatly simplifies the calculations of the remaining print area left as compared to a process in which the sensors and motors are operated asynchronously.

A random access memory (RAM) 100 stores the state of the sensors 70 and 72 from cycle to cycle to enable the CPU to determine that a change of state has occurred at a particular instant. A non-volatile programmable read only memory (EEPROM) 106 stores the program that controls the operation of the microprocessor 84, and also stores data relating to the postage indicia portion of the postage information image, since this portion of the image is fixed at the factory and cannot be altered by a customer, and provides this data to the print head 28 at the appropriate time. Memory 106 also stores data relating to the inscription and advertising slogan portions of the full image, since these portions of the full image can be customer altered by appropriate software substitution, and also provides this information to the print head 28 at the appropriate time. A counter 108 stores initial data indicative of the number of print columns in the length of the postage information image to be printed, and another counter 110 stores initial data indicative of a number of print columns which is in excess of the number of print columns stored in the counter 108. A pair of comparators 112 and 114 compare incoming count data from the CPU 96 with zero to determine when to signal the CPU 96 to make a change in the operational status of the mailing machine.

The complete operation of the mailing machine 10 will now be described. Before printing of any postage information images can occur, the microprocessor must be initialized to store the necessary data for the portions of the full postage information image that can be altered by the customer, and also to store the data indicative of the number of print columns in the image to be printed in one counter and a larger number in the other counter. Thus, at the time of installation of a new mailing machine, or at such time as the customer makes a change in the nature of the postage information image he is printing, the appropriate software for the customer alterable portions of the image is inserted into the EEPROM 106, and the counter 108 is set to store the number of print columns required to print the image which the customer desires. It should be understood that this can be just the postage indicia indicated by the letter P in FIG. 2, or the postage indicia P together with an advertising slogan indicated by the letter A in FIG. 2, or both the postage indicia P and the advertising slogan A with space in between (not shown on the drawing) for a suitable inscription relating to the category of mail being handled by the mailing machine. The software containing the image to be printed also carries with it the appropriate value of the counter 108, and the CPU 96 copies this value from the software to the counter 108 at the beginning of each printing cycle. In the situation where a customer selects orunselects optional print fragments or elements such as an advertising slogan or inscription, the software sums the number of columns in each of the fragments that will be printed, and initializes the counter with this value through the connections indicated by the dotted lines from the CPU 96 to the counters 108 and 110. Thus, each of these portions or fragments of the total postage information image being printed require a certain number of print columns, and the total of the fragments being printed is stored in the counter 108.

Once the CPU 96 has been appropriately initialized, and the mailing machine is powered up, the CPU 96 commences monitoring the condition of the sensors 70 and 72 through the sensor controller 86 as to whether they are blocked or unblocked, as the case may be, by an envelope E, and this information is transmitted back through the CPU 96 to the RAM 100 and stored there. Each time the CPU 96 monitors the sensors 70 and 72, as controlled by the timer 98, it signals the RAM 100 to ascertain whether the information received from the sensors 70 and 72 is the same or different from that previous stored in the RAM 100.

Figure 7:
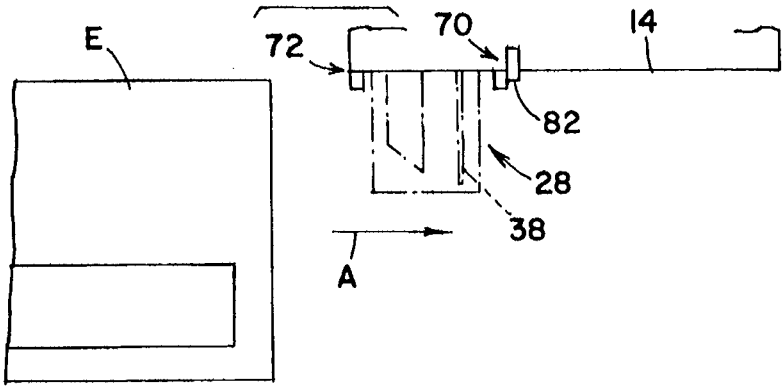
FIG. 7 is a plan view showing a standard size envelope being inserted into the mailing machine prior to the position of the lead edge of the envelope being sensed by the present invention.

With reference to FIGS. 3 and 7, when an envelope E is inserted into the mailing machine 10 in the direction of the arrow A, either manually or by a suitable envelope feeding device, the leading edge thereof first blocks the upstream sensor 72 and then blocks the downstream sensor 70 as it abuts the stop element 82, at which point the envelope E is blocking both of the sensors 70 and 72. As the blocking occurs, the sensors 70 and 72 transmit a different signal to the CPU from the blocked condition than from the unblocked condition, and this change in signal is stored in the RAM 100 and is then recognized by the CPU 96 as it monitors the RAM 100 with each monitoring cycle of the sensors 70 and 72. It should be understood that the CPU is programmed to initiate a printing cycle only when both sensors 70 and 72 are blocked by an envelope E, so that no operation of the mailing machine occurs until the envelope abuts the stop element 82.

Figure 8:
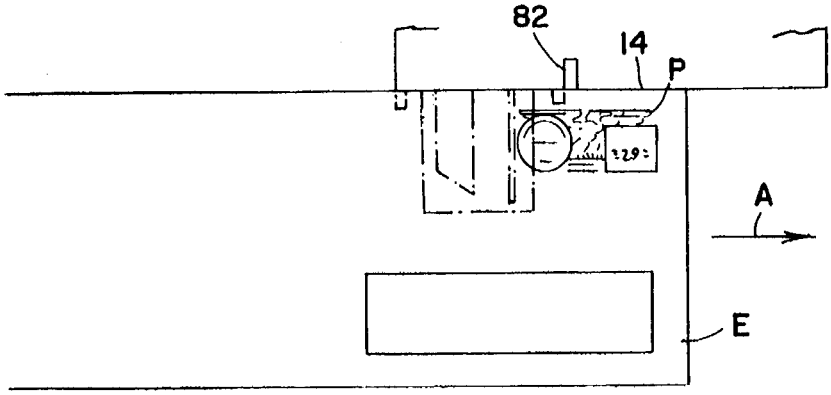
FIG. 8 is a view similar to FIG. 7 showing the envelope in a position in which the postage indicia is printed thereon after the lead edge of the envelope has been sensed.

When the envelope E is so positioned, as seen in FIG. 4, the CPU 96 sends a signal to the motor controller 88 which in turn energizes the crank motor 92 and the drive motor 90 to rock the frame 54 to the position shown in FIG. 3, and to start the drive motor 90 to commence rotation of the feed roller 52, in the manner fully described in the aforementioned copending patent application. Also, by any suitable mechanism, at the same instant as the foregoing, the stop element 88 is raised from the position shown in FIGS. 3 and 7 to that shown in FIGS. 5 and 8 to enable the envelope to commence movement along the feed deck 12. Simultaneously with energization of the feed roller 52, the CPU 96 also sends a signal to the printer controller 94 which in turn actuates the print head 28 to commence printing on the envelope E, as shown in FIG. 8. The software in the ROM 104 and the EEPROM 106 for the fixed postage indicia portion P of the postage information image being printed and the customer alterable portions thereof respectively controls the sequential energization of the individual heating elements in the array 38 thereof, to cause the print head 28 to print the desired image.

After initiation of the printing operation, several things occur simultaneously. The CPU continues to monitor the sensors 70 and 72 to detect any change in status thereof which would result from either sensor becoming unblocked. Also, the time 108 signals the CPU 96, which then instructs the printer controller 94 to cause the print head 28 to print a column and the motor controller 88 to "step" the drive motor 90, and the CPU 96 then signals the counters 108 and 110 through a line 116 to decrease their respective counts by a factor of one, with the result that the counters 108 and 110 constantly know exactly how many print columns have been printed at any given instant. Still further, the constantly changing count data in the counters 108 and 110 is fed to the comparators 112 and 114 respective, which compare the incoming counts with zero to ascertain when the counters 108 and 110 reach that value, whichever occurs first. When that happens, the appropriate comparator 112 or 114 signals the CPU 96 that either the counter 108 or 110 is has reached the zero value, and it is time for the CPU 96 to terminate the printing operation for one of two reasons, either that the full postage information image has been printed, as further explained below, or that the sensor 72 has detected the arrival of the trailing edge of the envelope E and the image counter 108 determines that there is insufficient envelope remaining between the print head 28 and the trailing edge of the envelope to accept the full postage information image to be printed, also as further explained below.

Figure 13:
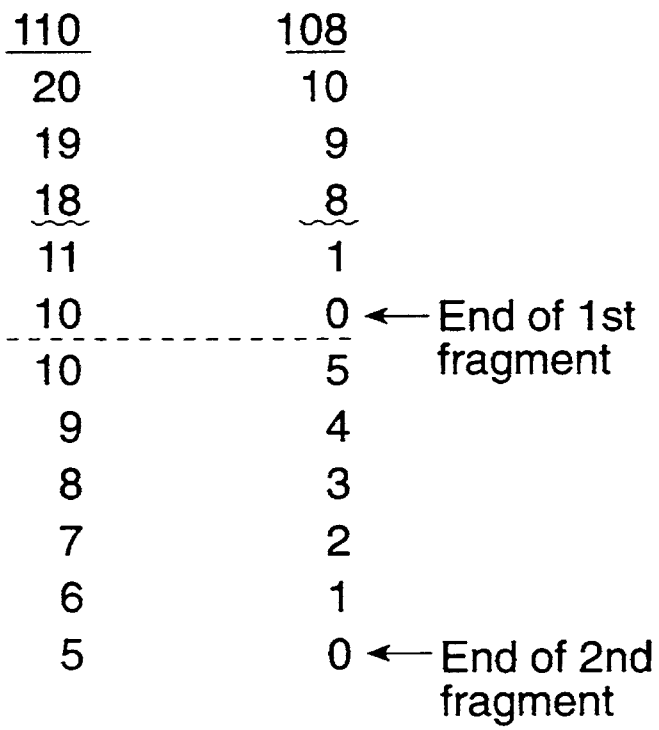
FIG. 13 is a representative tabulation of the count down sequence of two counters in the microprocessor, illustrating a situation where the full postage information image is printed on an envelope.

The various sequences of event that can occur will now be explained with reference to FIGS. 13, 14 and 15. FIG. 13 represents the situation in which the envelope E is long enough to accept the full postage information image to be printed. This is typically the case with standard #10 envelopes which are long enough to accept most if not all of the postage information images which are typically printed by most mailing machines. Thus, for the sake of illustration, assume that the image to be printed consists of two fragments, the postage indicia P which requires 20 print columns, and the advertising slogan A which requires only 5 print columns. It should be understood that these numbers are entirely unworkable and have been selected only to facilitate a clear understanding of the manner in which the control system for the mailing machine works.

Thus, FIG. 13 shows that the counter 110 has been initialized to indicate 20 print columns, and the counter 108 has been initialized to indicate 10 print columns, the number of print columns for the first or postage indicia fragment. As printing continues, and the counters 110 and 108 are decreased by a factor of one each time a print column is printed, as explained above, and both counters will decrease by a factor of 10 during the printing of the postage indicia fragment P. The first "0" in the counter 108 column represents the point at which the postage indicia fragment P has been fully printed. At this point, the CPU 96, not having received any signal to terminate printing, resets the counter 108 to the number of print columns required to print the second or advertising slogan fragment A, which in the illustration is 5. This is indicated by the dotted line immediately under the first zero in the column for the counter 108. The printing process continues uninterrupted and the print head now prints the advertising slogan fragment A as controlled by the software in the EEPROM 106.

As before, each time a print column is printed, both counters 108 and 110 are decreased by the CPU 96 by a factor of one, and in the illustration of FIG. 13, the counter 108 will reach zero before the counter 110, indicating that printing of the second fragment A will be completed before the counter 110 reaches zero, thereby indicating that the trailing edge of the envelope has not been sensed since there is still a print column count of 5 in the counter 110 when the counter 108 reaches zero for the second time. At this point, however, the EEPROM 106 signals the CPU 96 that there are no further fragments of the postage information image to be printed, so the CPU 96 instructs the printer controller 94 to stop further operation of the print head 28 and also instructs the motor controller 88 to stop operation of the feed roller 52 and to energize the crank motor 92 to move the frame 54 from the position shown in FIG. 4 to that shown in FIG. 5, in which the feed roller 52 is out of driving engagement with the envelope E and the ribbon 40, and the eject roller 56 now engages the lower surface of the envelope E and, in cooperation with the backup roller 58, ejects the envelope from the mailing machine. After the envelope E is fully ejected from the mailing machine, the CPU 96 instructs the motor controller 88 to stop operation of the eject roller 56 and return the frame 54 to the neutral position shown in FIG. 3. The printing operation is now complete and the mailing machine is in condition to accept the next incoming envelope.

Figure 9:
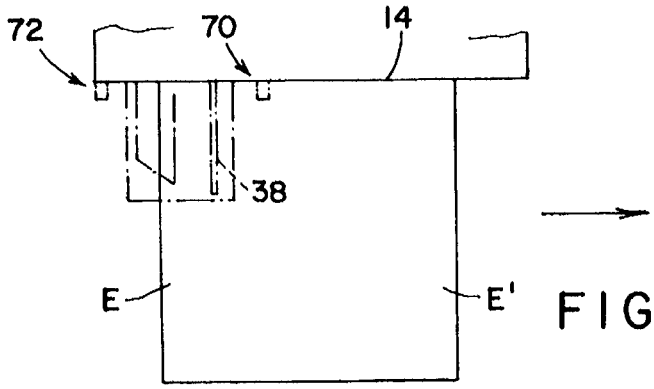
FIG. 9 is a view similar to FIG. 8 in which a short envelope or post card has been inserted into the mailing machine on which the entire postage indicia and ad slogan image will not fit.

As indicated above, the foregoing series of events will occur repeatedly so long as envelopes are continuously fed into the mailing machine which are of sufficient lengthy to accept the full postage information image that is programmed into the microprocessor 84. The problem that arises, to which the present invention is directed, is that, as will now be apparent, if an envelope E is fed into the mailing machine that is too short to accept the full postage information indicia programmed into the microprocessor, such as is indicated by the envelope E' shown in FIG. 9, the print head 28 will continue to operate after the trailing edge of the envelope has passed beyond the feed roller 52, resulting in the transfer of ink from the ribbon 40 to the feed roller 52, resulting in the adverse consequences detailed above. This is prevented, basically, by operation of the counter 110, which ordinarily is set to a print column value which is greater than that in the counter 108 at the start of a printing operation so that if the envelope is long enough to accept the full postage information image programmed into the microprocessor 84, the counter 110 will never reach zero. However, FIG. 14 illustrates the situation in which the trailing edge of the envelope E is sensed by the sensor 72 prior to completion of printing of the amount of postage information image programmed into the microprocessor, and it becomes necessary to determine at that point whether or not there is sufficient envelope remaining between the trailing edge thereof and the print head 28 to accept whatever amount of postage information image remains to be printed.

Figure 14:
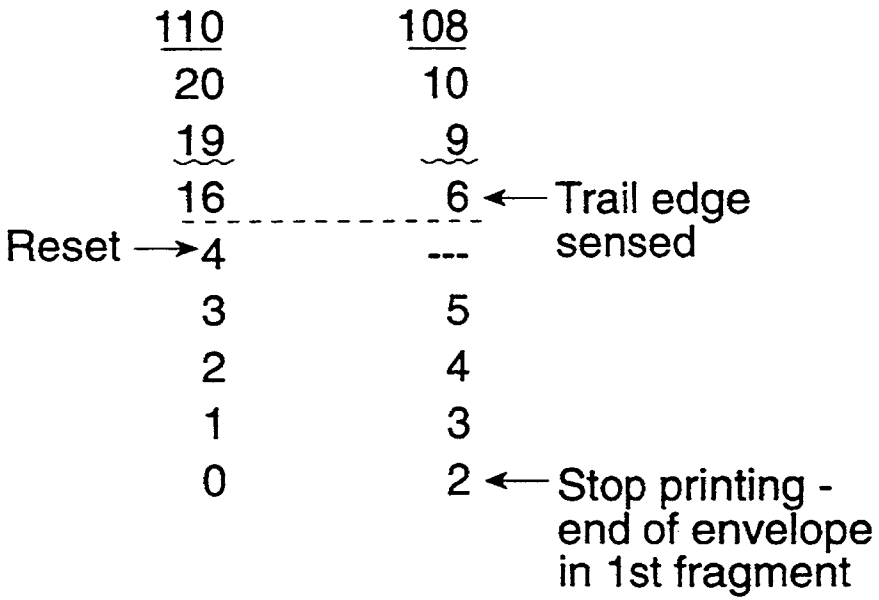
FIG. 14 is a view similar to FIG. 13, but illustrating the situation where the printing operation is discontinued during printing of the first fragment of a postage information image.

Thus, referring to the print column count example shown in FIG. 14, assume the same number of print column counts for a two fragment image as before, and make the additional assumption that the amount of envelope between the trailing edge thereof and the print head 28 at the instant that the trailing edge is sensed by the sensor 72 will accept only 4 print columns. When printing is initiated as explained above and continues until the trailing edge of the envelope is sensed by the sensor 72, the CPU 96 will recognize the change in condition of the sensor 72 from that stored in the RAM 100 to that now transmitted to the RAM 100, and the CPU now resets the counter 110 to the value that is indicative of the number of print columns that will physically fit on the length of envelope between the training edge thereof and the print head 28, which is four. Thus, FIG. 14 shows a reset in the counter 110 count from 16 to 4 above and below the dotted line respective. As printing now continues, the counter 108 and 110 continue to count down in the manner as explained above, but now the counter 110 will reach zero prior to the counter 108, at which time the comparator 114 sends a signal to the CPU 96 indicating that the end of the envelope has arrived at the print head 28 and printing should be terminated. The CPU 96 responds to this signal and instructs the printer controller 94 to terminate printing in the manner explained above and also instructs the motor controller to stop the feed roller 52 and engage the eject roller 56 in the manner explained above. Thus, this illustration shows that there was insufficient space on the envelope to complete the printing of even the first fragment P of the postage information image, and that printing was terminated during the printing of this fragment. Although the system software will support this mode of operation, it is unlikely in actual practice that an envelope would be so short that it could not receive at least the full length of any postage indicia, whether of the United States Postal Service or of some foreign country, constituting the first fragment of the full postage information image. It should therefore be understood that this mode of operation has been included to facilitate a full understanding of the principles of the method of the present invention. In most situations in actual practice, an envelope would be long enough to accept at least the postage indicia fragment, so that printing of the full postage information image would be terminated during printing of the second fragment, as described in the next paragraph.

Figure 15:
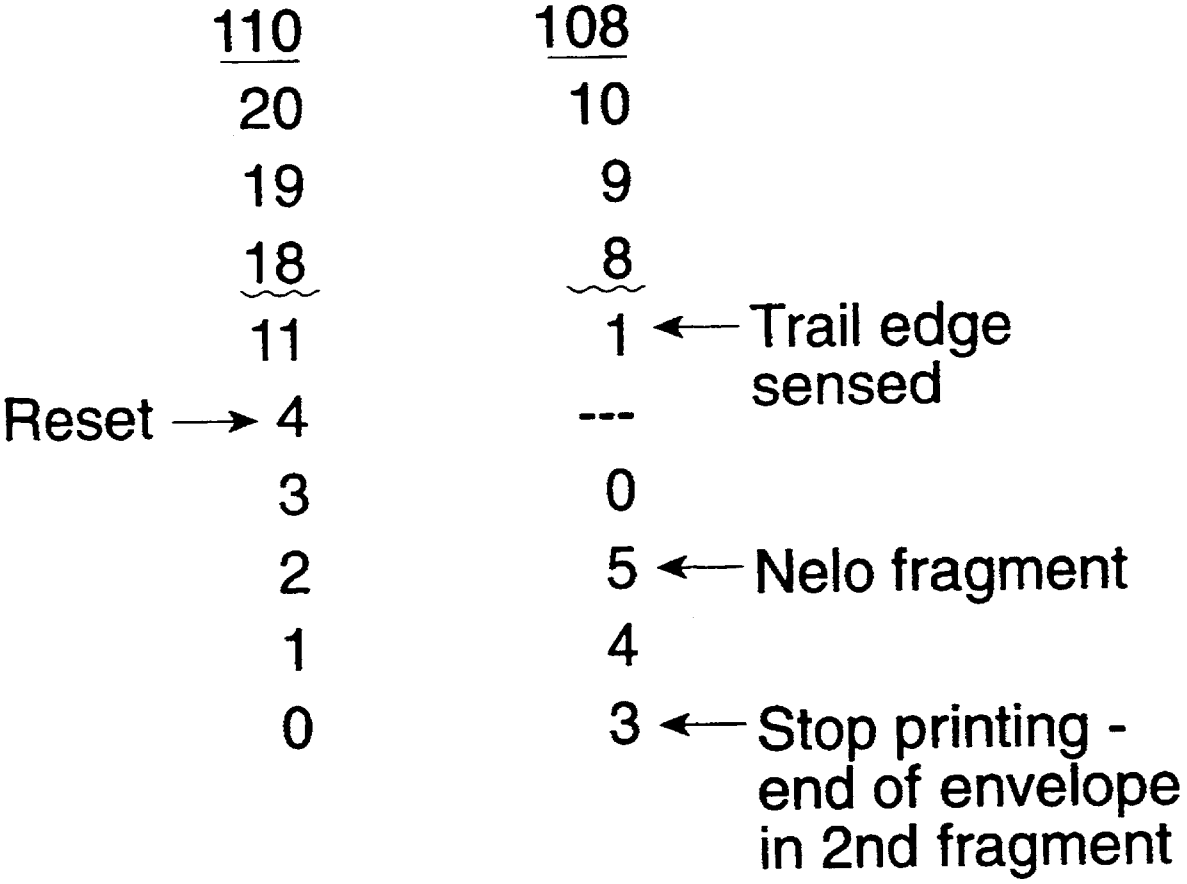
FIG. 15 is a view similar to FIG. 13, but illustrating the situation where the printing operation is discontinued during printing of a subsequent fragment of a postage information image.

FIG. 15 illustrates a situation very similar to the one explained above, except that the numbers are arbitrarily selected so that the trailing edge of the envelope is sensed during the printing of the second fragment rather than the first. Thus, it will be seen that during the printing operation, the trailing edge of the envelope is not sensed by the sensor 72 until the next to last print column for the counter 108 is printed, i.e., the trailing edge of the envelope is sensed after nine print columns have been sensed. At this point, the counter 110 is again reset to four, which represent the number of print columns that will fit on the envelope between the trailing edge thereof and the print head 28. As printing continues, the last print column of the first fragment is printed, represented by the zero below the short dotted line in the counter 108 column, after which printing of the next fragment of image commences. But this fragment requires 5 print columns to print in its entirety, but only 4 print columns will fit on the envelope between the trailing edge thereof and the print head, one of which was utilized in printing the last print column of the previous fragment. Therefore, only three print columns of the second fragment will be printed on the envelope before the printing operation is terminate by the CPU 96 in response to the signal from the comparator 114 that the counter 110 has reached zero.

Figure 10:
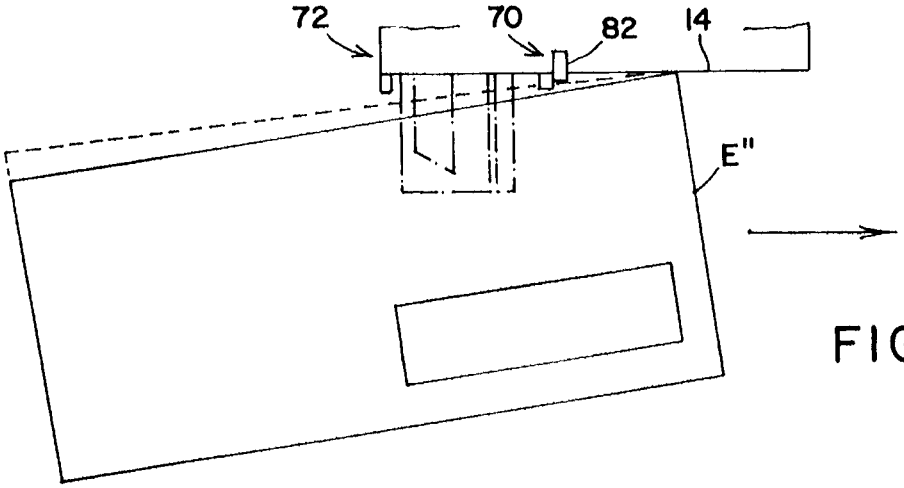
FIG. 10 is a view similar to FIG. 7 showing an envelope that is skewed to the normal direction of feed and therefore exposes a portion of the printing feed roller.

One aspect of the apparatus and method of the present invention that has been mentioned briefly hereinabove, but not covered in the detailed description of the invention, is that the sensor 72 will function in the same manner after detecting the upper edge of an envelope that is fed into the mailing machine with a slight degree of skew with respect to the registration guide 14 as it does when detecting the trailing edge of an envelope that is properly fed into the mailing machine. Thus, with reference to FIG. 10, it will be seen that an envelope E" has been fed into the mailing machine with such a degree of skew that, when the upper right hand corner reaches the downstream sensor 70, the upstream sensor 72 has already been uncovered by the upper edge of the envelope E", with the result that neither of the sensors 70 or 72 are simultaneously covered by the envelope E", which, as explained above, is a condition that will prevent a printing operation from being initiated by the CPU 96. Thus, nothing will be printed on an envelope that is fed into the mailing machine with such a severe degree of skew.

If the envelope E" is fed into the mailing machine with only a slight degree of skew, such as indicated by the dotted line in FIG. 1 0, it is possible that both sensors 70 and 72 may be covered so as to initiate a printing operation. However, as the envelope E" is moved forwardly, the upstream sensor 72 will be uncovered at some point along the upper edge of the envelope E". This will trigger the CPU 96 to terminate the printing operation in the same manner as described above in the situation where the sensor 72 detects the trailing edge of an envelope E which has initially been properly fed into the mailing machine. Thus, from the standpoint of the invention, reference to 'trailing edge' in the appended claims is to be interpreted as meaning either the actual trailing edge of an envelope or the upper edge thereof.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

What is claimed is:

1. A mailing machine for printing an image on an envelope fed in a feed path, the mailing machine comprising:

means for printing the image on the envelope, means for feeding the envelope along the feed path, first sensing means located a predetermined distance upstream in the feed path from the printing means for detecting the presence of the envelope, control means in communication with the printing means and the first sensing means, the control means for:

initiating a printing operation to print the image on the envelope, monitoring an amount of the image remaining to be printed by the print means during an active printing operation, and terminating printing by the print means before completion of the printing operation if, at the time when the first sensing means detects the trailing edge of the envelope, the amount of the image remaining to be printed will not fit on the length of the envelope between the printing means and the first sensing means.

2. A mailing machine as set forth in claim 1, wherein:

the printing means prints the image in columns, and the control means includes first counter means and second counter means, the first counter means for indicating a count of a number of print columns required to print the image, the second counter means for indicating a predetermined count of a number of print columns which will be allowed to print after the first sensing means detects the trailing edge of the envelope.

3. A mailing machine as set forth in claim 2, wherein:

the control means decreases the count in the first counter means by one for each print column printed and, once the first sensor means detects the trailing edge of the envelope, decreases the count in the second counter means by one for each print column printed, and the control means terminates printing if the count in the second counter means reaches zero before the count in the first counter means so that printing terminates before completion of the printing operation.

4. A mailing machine as set forth in claim 3, wherein:

the control means terminates printing if the count in the first counter means reaches zero before the count in the second counter means so that printing terminates after completion of the printing operation, and the control means resets the count in the first counter means to the number of print columns required to print the image and the count in the second counter means to the number of print columns which will be allowed to print after printing terminates.

5. A mailing machine as set forth in claim 4, the mailing machine further comprising:

second sensing means located a predetermined distance downstream in the feed path from the printing means for detecting the presence of the envelope, and wherein the control means only initiates the printing operation when the first sensing means and the second sensing means detect the presence of the envelope.

6. A mailing machine as set forth in claim 5, wherein the image includes information indicative of postage.

7. A method of controlling print means for printing an image on an envelope fed in a feed path through a mailing machine, the mailing machine including first sensing means located a predetermined distance upstream in the feed path from the printing means for detecting the presence of the envelope, the method comprising the steps of:

(a) initiating a printing operation to print the image on the envelope, (b) monitoring an amount of the image remaining to be printed by the print means during an active printing operation, and (c) terminating printing by the print means before completion of the printing operation if, at the time when the first sensing means detects the trailing edge of the envelope, the amount of the image remaining to be printed will not fit on the length of the envelope between the printing means and the first sensing means.

8. A method as set forth in claim 7, wherein the printing means prints the image in columns, and wherein step (b) further includes the steps of:

(b1) maintaining a first count indicative of a number of print columns required to print the image, (b2) maintaining a second count indicative of a predetermined number of print columns which will be allowed to print after the first sensing means detects the trailing edge of the envelope.

9. A method as set forth in claim 8, wherein step (b) further includes the steps of:

(b3) decreasing the first count by one for each print column printed, and (b4) decreasing the second count by one for each print column printed after the first sensor means detects the trailing edge of the envelope.

10. A method as set forth in claim 9, wherein step (c) further includes the steps of:

(c1) comparing the first count and the second count to zero, and (c2) terminating printing if the second count reaches zero before the first count so that printing terminates before completion of the printing operation.

11. A method as set forth in claim 10, further comprising the steps of:

(d) terminating printing if the first count reaches zero before the second count so that printing terminates after completion of the printing operation, and (e) resetting the first count to the number of print columns required to print the image and the second count to the number of print columns which will be allowed to print after printing terminates.

12. A method as set forth in claim 11, wherein the mailing machine includes second sensing means located a predetermined distance downstream in the feed path from the printing means for detecting the presence of the envelope, and step (a) further includes the step of:

(a1) initiating the printing operation only when the first sensing means and the second sensing means detect the presence of the envelope.

* * * * *